US006170665B1

(12) United States Patent
Pehr

(10) Patent No.: US 6,170,665 B1
(45) Date of Patent: Jan. 9, 2001

(54) GREETING CARD AND TIE

(76) Inventor: Harold T. Pehr, P.O. Box 26265, Shawnee Mission, KS (US) 66225

( * ) Notice: Under 35 U.S.C. 154(b), the term of this patent shall be extended for 0 days.

(21) Appl. No.: 09/290,274

(22) Filed: Apr. 13, 1999

(51) Int. Cl.[7] ..... B65D 85/18

(52) U.S. Cl. ..... 206/752; 206/292; 206/295; 206/459.5; 206/806

(58) Field of Search ..... 206/45.21, 45.22, 206/278, 292, 295, 296, 752, 756, 760, 762, 806, 459.5; 229/148

(56) References Cited

U.S. PATENT DOCUMENTS

| | | | | |
|---|---|---|---|---|
| 409,703 | * | 8/1889 | Procter | 206/292 |
| 412,470 | * | 10/1889 | Cohn | 206/752 |
| 1,134,722 | * | 4/1915 | Brown | 206/292 |
| 1,594,363 | * | 4/1926 | Glick | 206/278 |
| 1,662,039 | * | 3/1928 | Heynen | 206/292 |
| 3,659,704 | * | 5/1972 | Collura et al. | 206/295 |
| 4,678,079 | * | 7/1987 | Henning | 206/279 |
| 4,944,395 | * | 7/1990 | Coursen | 206/279 |
| 5,458,233 | * | 10/1995 | Herrin | 229/117.14 |

* cited by examiner

*Primary Examiner*—Jim Foster

(57) ABSTRACT

A combination greeting card box and gift tie has several unique point of sale features. The concept has a shipping box that doubles as a point of sale display for the box and the gift tie it is designed to contain. The box has an open position where it functions as a hanging point of sale display and a closed position where it functions as a shipper for the gift tie. In the open position an integral cardboard tab serves to hold the shipper and gift tie on display. A second integral tab holds the tie. Once purchased the customer will fold up the shipper box using integral living hinges and closes the shipper box using integral locks. The concept is shown using a tie as the gift item.

4 Claims, 3 Drawing Sheets

GREETING CARD AND TIE

BACKGROUND OF THE INVENTION

It is common in the greeting card industry to include a small gift item that is packaged and sold with a greeting card. Sometimes a greeting card will even take the form of a small shipper box that can be folded up by the end user to contain the gift item. These prior art shipper devices typically do not contain any adaptations that help to sell the shipper/gift combination at the point of sale. The focus of most prior art patents is simply to provide a shipper for the convenience of the purchaser.

One prior art patent that does give some consideration to the point of sale is U.S. Pat. No. 4,140,317 to Ramney. This patent provides for a gift item that does have a point of sale display device, however in this patent the point of sale device is part of the paper product that the shipper contains. This is fine for inexpensive paper products but would not work for other products such as clothing where it is not desirable to have the shipper permanently attached to the product.

None of the prior art devices provide a way of hanging a clothing item such as a tie at the point of sale along with the shipper box.

SUMMARY OF THE INVENTION

The invention relates generally to combination gift and shippers for the gift product. The present invention provides for an attractive point of sale display with integral tabs for display of the combination packages as well as for display of the gift item within the package.

The design allows for display of a variety of different clothing items within a single gift box. The shipper box provides a convenient means for the store keeper to display the package as well as providing the customer with a way of shipping the product.

The package provides a unique way of displaying a tie for resale.

DESCRIPTION

Figure 1:
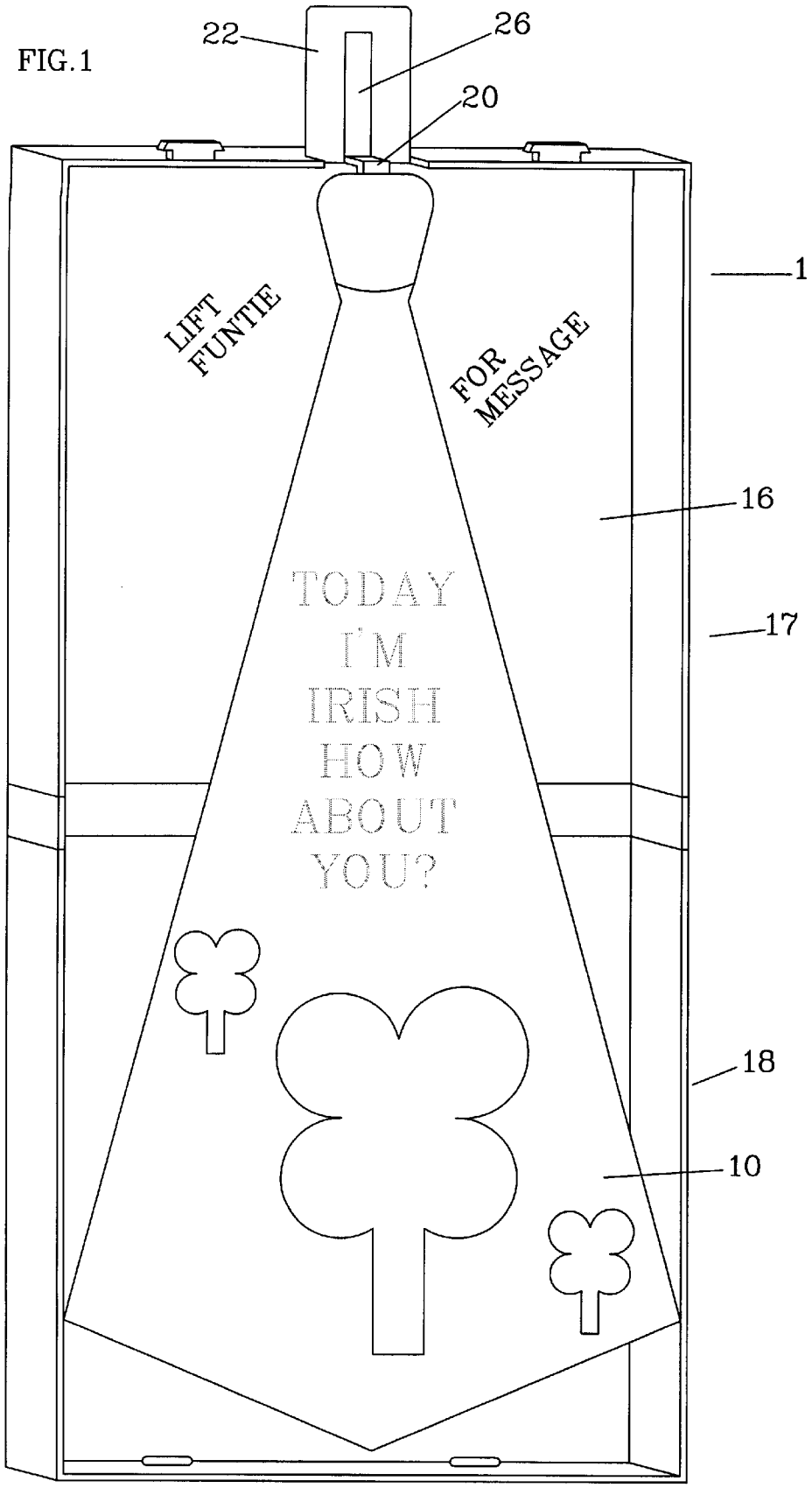
FIG. 1 Shows the combination package with the tie in the hanging position and the box open FIG. 2 Shows the shipper box in the closed position FIG. 3 Shows the shipper box prior to assembly as it would appear after die cut and printing FIG. 4 Shows details of the tie

Referring to FIG. 1, the combination container and tie (1) is shown with the gift tie (10) in place. The gift tie (10) can have a variety of messages printed on it and the shipper box (16) can have coordinating messages. The shipper box (16) has a lid (17) and a base portion (18). FIG. 1 shows the shipper box (16) in the open position as it would be in the store prior to purchase by the customer. In this position a first integral cardboard tab (20) supports the tie and a second integral cardboard tab (22) forms a hanger that supports the whole package from the store display. The second tab (22) has a slot (26) that is formed when the first tab (20) is bent down to attach the tie (10).

Figure 2:
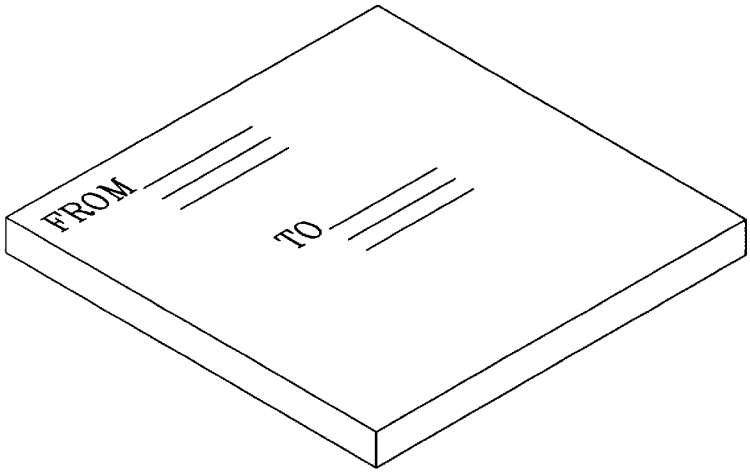

FIG. 2 shows the shipper box in the closed position ready for mailing. Pre-printed mailing information can be placed on the outside of the box for the convenience of customers.

Figure 3:
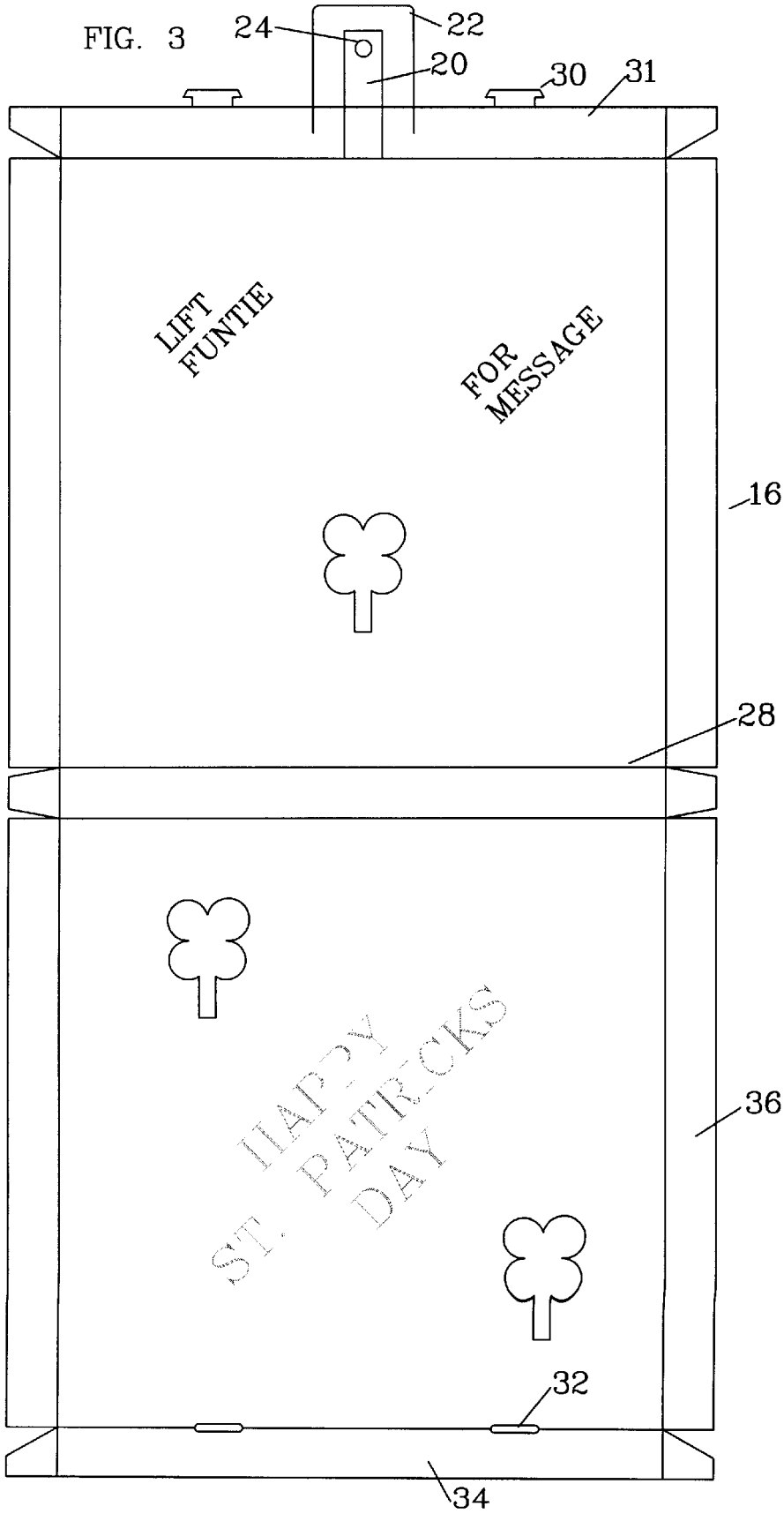

FIG. 3 shows the shipper box (16) in the broken down position as it would be immediately after being die cut and printed. The tabs (20 and 22) are formed but not yet punched out. A preformed hole (24) allows the tie to be hung from the package for display in the store. Hinge lines (28) allow the box to be folded into the closed position. Locks (30) formed on the edge of wall (31) fit into slots (32) on the bottom portion of the box and retain the box in the closed position. Other walls (34,36) give the box depth and prevent the tie from becoming crushed during shipment.

Figure 4:
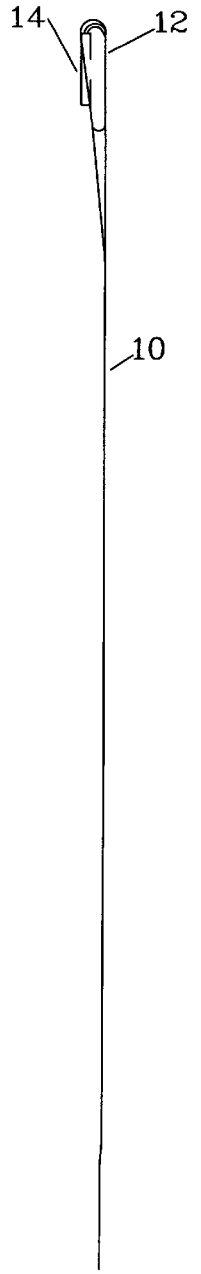

FIG. 4 shows the details of the tie (10) including a clasp (12) with hook (14). The hook (14) which comes from the backside of the tie clasp (12) allows the tie to hang from tab (20) and later from the shirt of the person who ultimately will wear the tie.

In use, the manufacturer will print coordinated messages on the tie and shipper box. The box will be assembled as shown in FIG. 1, the tab (20) will be punched out and the tie clasp hook (14) will pass thru hole (24) to support the tie. The package will then be displayed in the store in the open position of the shipper box. Tab (22) will support the package from a peg in the store. Once purchased, the shipper box is closed and held shut by locks (30). The outside of the package is then addressed and sent. Once received the shipper box is opened and the tie is once again supported in the hanging position by tab (20). The receiver can then remove the tie (10) and wear it over almost any shirt or blouse by slipping the clasp hook (14) over the neck of their shirt or blouse.

Although the best embodiment know has been disclosed, variations in the design are possible. For example, the tabs (20 and 22) are shown as being die cut with the box, they could be made as plastic labels that would have adhesive to attach them to the box. Also a variety of box closure designs are possible.

What is claimed is:

1. A greeting card box and tie combination;

said box having an open position and a closed position, said box having a base portion and a lid portion hingedly attached to said base portion; a first tab on said lid, said first tab supporting the tie in a hanging position in the open position of said box; said box having closure means to hold it in the closed position during shipping of said greeting card box and tie combination.

2. The greeting card box and tie combination of claim 1 wherein;

said tie includes a hook that fits through a hole in said first tab.

3. A shipper box and tie combination;

said shipper box formed from a single blank and said box having a lid portion and a base portion attached together along a common edge, a first tab on said lid for supporting the tie in an in store display position when said box is in an open position with said lid and base in a nearly co-planar arrangement, said tie sandwiched between said lid and said base in a closed position of said box with said lid and base in an overlapping position and including means to lock said box in said closed position for shipping.

4. The shipper box and tie combination of claim 3 including;

said first tab being attached to a portion of the tie such that when the box is re-opened the tie will again be supported from the tab.

* * * * *